United States Patent [19]

Gess

[11] 4,338,761

[45] Jul. 13, 1982

[54] MACHINE FOR PRODUCING PACKAGES WITH LABELS

[76] Inventor: Larry C. Gess, 9270 Secor Rd., Temperance, Mich. 48182

[21] Appl. No.: 224,639

[22] Filed: Jan. 12, 1981

Related U.S. Application Data

[63] Continuation-in-part of Ser. No. 24,965, Mar. 29, 1979, Pat. No. 4,244,159.

[51] Int. Cl.[3] ..... B65B 61/00; B65B 61/26

[52] U.S. Cl. ..... 53/137; 53/552; 53/567; 156/461; 156/471; 156/479; 156/545; 156/468

[58] Field of Search ..... 53/137, 415, 457, 459, 53/469, 452, 481, 547, 552, 384, 385, 386, 567, 548; 156/461, 464, 465, 468, 471, 479, 545

[56] References Cited

U.S. PATENT DOCUMENTS

| | | | |
|---|---|---|---|
| 1,521,725 | 1/1925 | Stanley | 53/137 |
| 2,847,806 | 8/1958 | Wang | 53/459 |
| 3,070,927 | 1/1963 | Lundahl | 53/548 X |
| 3,264,794 | 8/1966 | Brown et al. | 53/549 |
| 3,543,466 | 12/1970 | Forsberg | 53/459 |
| 3,792,565 | 2/1974 | Goransson | 53/567 |
| 3,908,335 | 9/1975 | Giannelli | 53/567 X |
| 3,948,019 | 4/1976 | Döring et al. | 53/385 X |
| 4,091,595 | 5/1978 | Pelster et al. | 53/137 X |
| 4,094,125 | 6/1978 | Gess | 53/384 X |

*Primary Examiner*—Horace M. Culver
*Attorney, Agent, or Firm*—Allen D. Gutchess, Jr.

[57] ABSTRACT

A machine for making packages with labels is provided. The packaging machine utilizes a supply of packaging material in the form of a length of plain plastic tubing and a supply of labels in the form of a continuous strip thereof. In a previous cycle of the machine, the tubing was heat sealed along a transverse strip near the leading edge thereof. The strip is subsequently advanced a predetermined distance between a first set of jaws which close, with a first sealing wire carried by one of the jaws then energized to seal a leading edge of the tubing which will form the next package. A knife severs the tubing below that seal and the upper edges of the severed section which has been advanced are engaged by clamps. These move apart with the jaws to open the upper edges, thereby enabling an article to be dropped into the resulting pocket in the severed package section. The jaws then close once again and a second sealing wire below the clamps seals the upper edges of the severed section. The clamps are then released and the jaws open a second time so that the resulting package with the packaged article is discharged from the machine. During the above operations and prior to the jaws being opened the second time, the strip of labels is advanced and individual labels are severed therefrom. A severed label is formed into a V-shaped configuration by male and female V-shaped blocks and is then moved by the female block around the leading edge of the severed section having the transverse sealed strip. Third sealing wires carried by an additional set of jaws then seal the label to the severed package section near the transverse sealed strip.

14 Claims, 9 Drawing Figures

MACHINE FOR PRODUCING PACKAGES WITH LABELS

This application is a continuation-in-part of my copending application Ser. No. 024,965, filed on Mar. 29, 1979 and now U.S. Pat. No. 4,244,159.

This invention relates to a machine for producing labeled packages from a continuous length of flexible tubing and from a strip of labels.

The machine according to the invention employs packaging material in the form of plain, plastic tubing. The tubing has no special seal, slits, or shapes and, therefore, constitutes a low-cost source of packaging material. The labels also preferably are supplied in a continuous strip which can have special shapes or holes to enable the packages to be hung for display purposes. The machine is relatively simple in design and low in cost and maintenance.

The packaging machine employs a first set of engagable members or jaws, at least one of which is moveable toward and away from the other and toward and away from the flexible tubing fed in a path therebetween. One of the jaws has a first, upper sealing wire with the outer jaw having a backup strip at the same position. One of the jaws also has a second, lower sealing wire with the other jaw having a backup strip at the same position. A moveable knife is carried by one of the jaws at a location between the wires and backup strips. The knife is mounted for movement across the tubing in a direction parallel to the sealing wires and strips to sever the tubing and to thereby form a package section at the leading edge of the tubing. The jaws also have clamping means below the knife and above the second sealing wire for engaging upper severed edges of the severed package section and for opening that section to form a pocket therein in which an article is inserted when the clamping means and the jaws are moved apart.

For the labeling portion of the machine, the supply of labels in the form of a continuous strip of them are mounted on the machine with the label strip being fed in a path by suitable rolls which can be stopped and started by sensing means which is sensitive to marks or openings in the label strip. When the labels are advanced and stopped, a label at the leading edge of the strip is severed, after which the severed label is formed into a V-shaped configuration by a lower V-shaped female block and an upper V-shaped male block. The label strip can be longitudinally perforated to facilitate the formation thereof into the V-shaped configuration. The female V-shaped block also can have openings therein communicating with a vacuum source to hold the label in position on this block. The severed, shaped label is then moved by the female V-shaped block into a position around the leading edge of the severed package section having the first transverse sealed strip thereon. The machine has a second set of jaws which then move together with heating strips or wires to seal the label in position near the leading edge of the package section.

In the operation of the packaging machine, the leading edge of the tubing, at the beginning of a cycle, projects into the space between the tops of the first set of jaws, with the leading edge of the tubing having been transversely sealed by the first sealing wire during the previous cycle. The tubing is then advanced between these jaws a predetermined distance, at which time the jaws close and the first sealing wire is energized to form a transverse seal which will subsequently be the leading edge of the tubing for the next package. The knife below the first sealing wire then moves transversely across the tubing to form a severed package section below the last seal. The clamping means of the jaws then engage the upper severed edges of this severed package section and subsequently move apart to open the severed edges so that an article can be inserted into the pocket formed in the severed section. The jaws then move toward the tubing again and the second sealing wire is energized to seal the top of the severed package section just below the severed edges thereof. When the jaws are opened a second time, the clamping means are released and the newly-formed package is discharged from the machine.

During the above operations and before the set of jaws open the second time, the strip of labels is moved along its path and stopped by the sensing means, at which time the forward label is severed from the remainder. The severed label is then formed into the V-shaped configuration by the male and female V-shaped blocks. The shaped label is then moved by the female block toward the leading, sealed edge of the severed package section with the leading edge near the lowermost portion of the valley of the V-shaped section. The second moveable jaws are then brought together to squeeze the label against the sides of the package section and the third sealing wires are energized to seal the label on that section. The female V-shaped block is then retracted prior to the first set of jaws being opened to discharge the now-labeled package.

It is, therefore, a principal object of the invention to provide a packaging machine which forms labeled packages at a high rate of production.

Another object of the invention is to provide a packaging machine for forming labeled packages from plain tubing and from a strip of labels, which machine is of relatively simple design and low in cost.

A further object of the invention is to provide a packaging machine which forms labeled packages which is relatively maintenance free.

Many other objects and advantages of the invention will be apparent from the following detailed description of a preferred embodiment thereof, reference being made to the accompanying drawings, in which.

Figure 4:
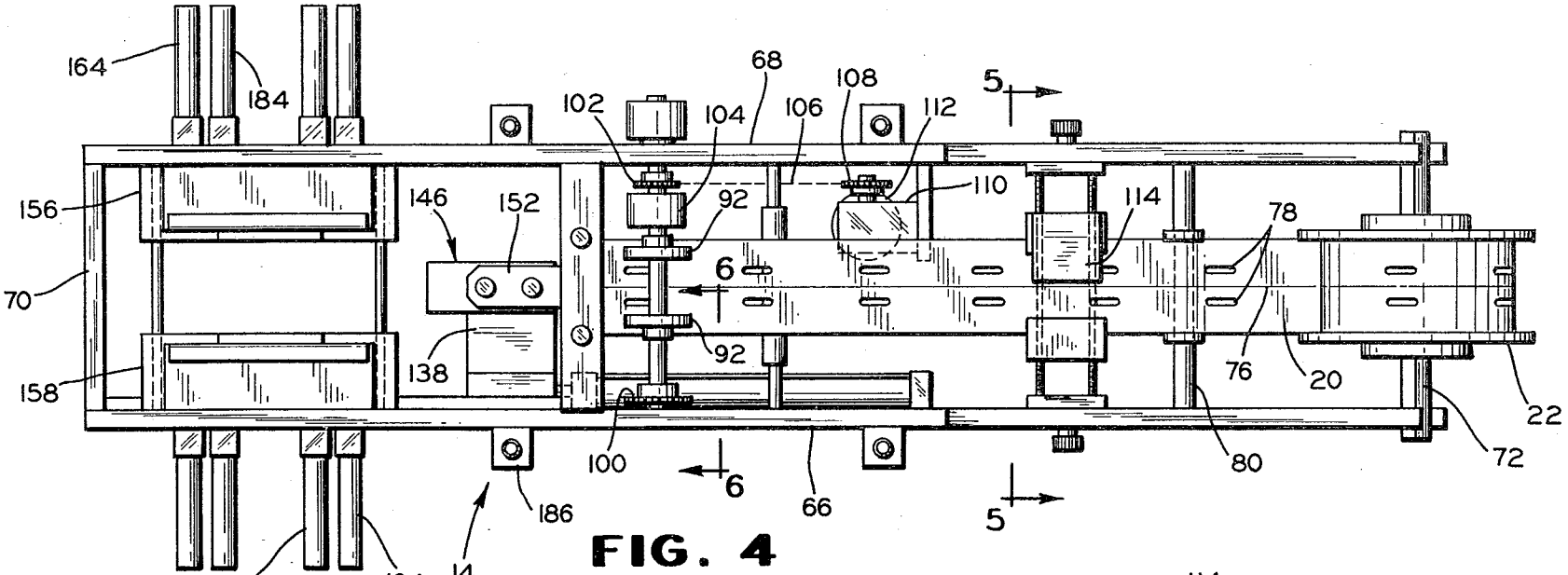
FIG. 4 is a somewhat schematic plan view of the labeling apparatus of the machine.
Figure 5:
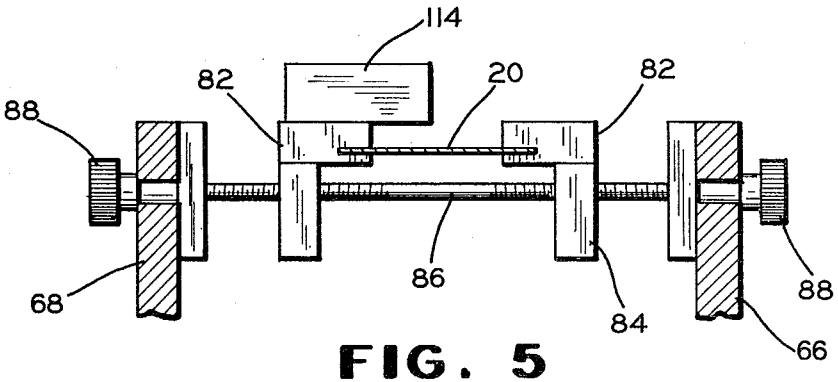
Figure 6:
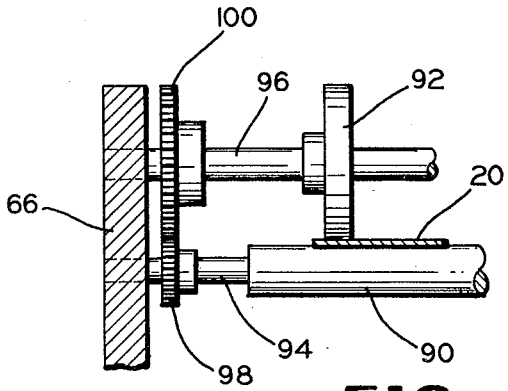
Figures 7, 8, 9:
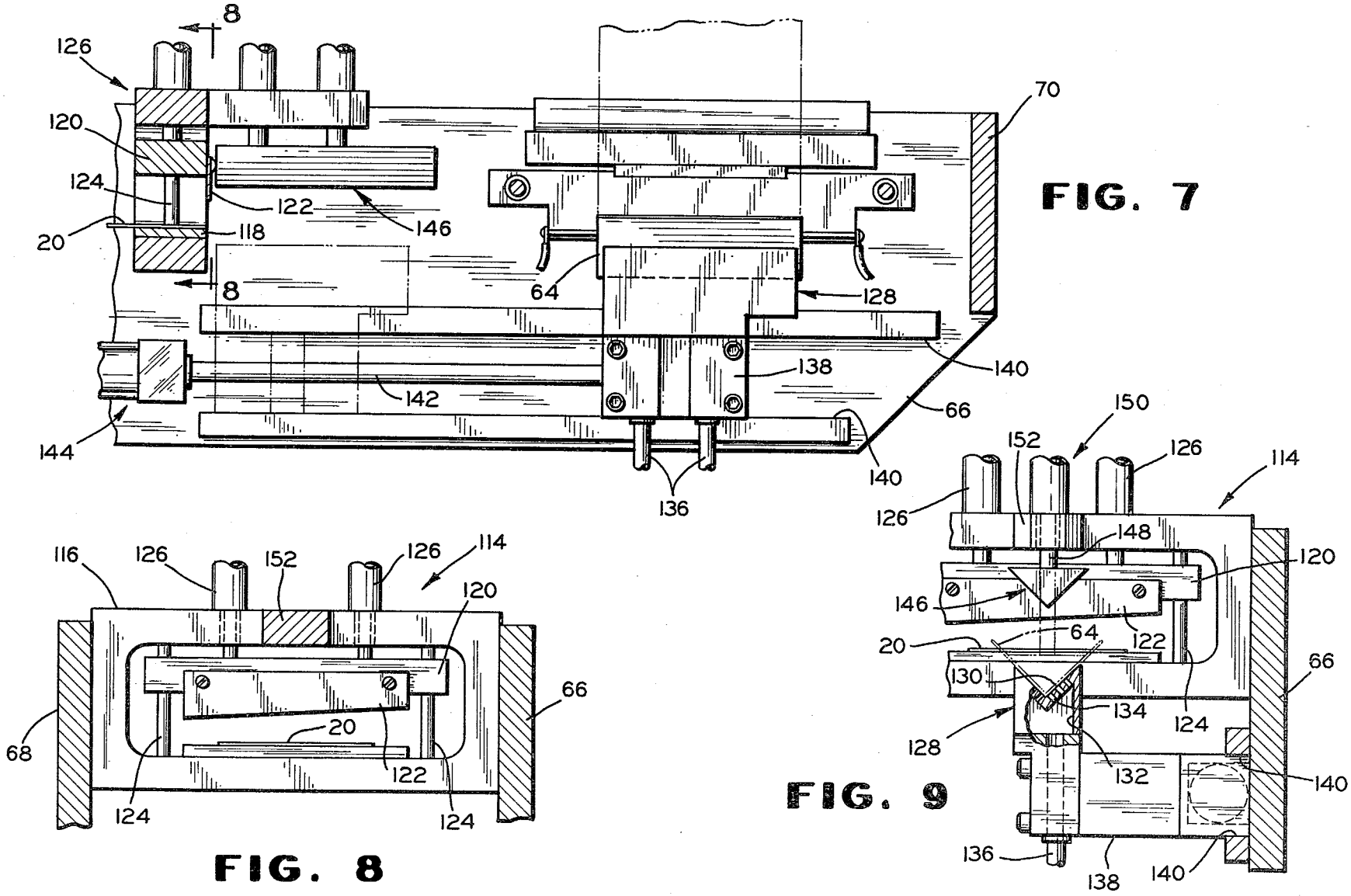

FIGS. 5 and 6 are somewhat schematic views in transverse cross section, taken along the lines 5—5 and 6—6 of FIG. 4;

FIG. 7 is an enlarged, somewhat schematic view in elevation, with parts in section, of an end portion of the labeling apparatus;

FIG. 8 is a view in transverse cross section taken along the line 8—8 of FIG. 7; and FIG. 9 is a view similar to FIG. 8 but with additional components of the labeling apparatus shown.

Figure 1:
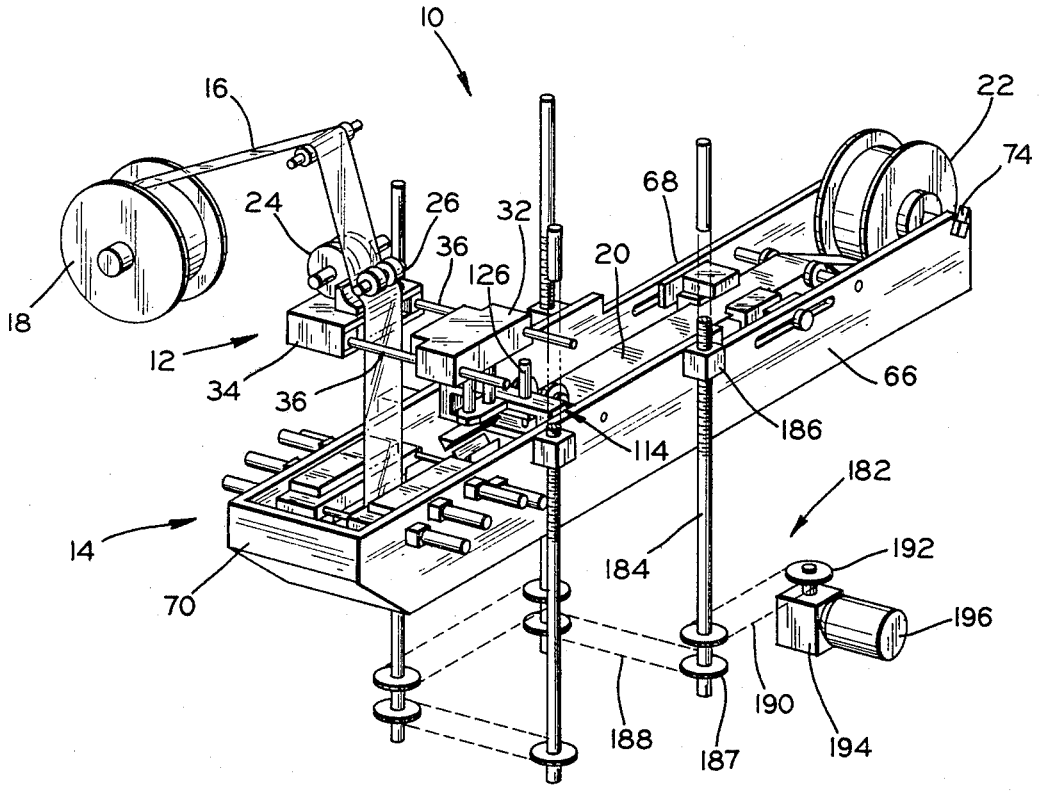
FIG. 1 is a schematic view in perspective of an overall packaging machine without the housing, for producing labeled packages in accordance with the invention.

Referring to FIG. 1, an overall packaging and labeling machine 10 is shown without the housing. The machine includes a first, upper package-forming station 12 at which the packages are formed and a second, lower labeling station 14 at which labels are applied to the leading edges of the newly-formed packages. The packaging material is in the form of plain, flexible, plastic tubing 16 which is supplied from a spool 18. The labels are made from a continuous strip 20 on which indicia is sequentially printed and in which holes can be formed, if desired, to facilitate hanging the packages on a display board or the like. The strip 20 is supplied from a spool 22 and fed transversely to the tubing 16.

The tubing 16 is advanced by rubber-covered rolls 24 and 26 which are driven by suitable means (not shown). The tubing moves down a curved surface 28 and between a first set 30 of jaws 32 and 34. In this instance, the jaw 32 is fixed and the jaw 34 is moveable toward and away from the path of the tubing 16, although both jaws could be moved if desired. The moveable jaw 34 is mounted on guide rods 36 (FIGS. 1 and 3) and moves by suitable fluid-operated rams (not shown). The stationary jaw 32, in this instance, has an upper backup strip 38 (FIGS. 2 and 3) opposite which the moveable jaw 34 has an electrically-heated sealing strip or wire 40. These form a transversely disposed seal 42 or sealed strip (FIG. 2) near the leading edge of the tubing 16 when the jaws are brought together and power is supplied to the wire 40. A knife blade 44 is located below the backup and sealing strips 38 and 40 and is mounted in a guide block 46 which is guided for movement transversely of the path of the tubing 16 by a slot 48 in the jaw 32. The block and knife are also driven by a suitable fluid-operated ram (not shown) with the stroke length of the knife blade exceeding the width of the widest tubing to be used with the packaging machine 10.

The stationary and moveable jaws 32 and 34 have clamping means indicated at 50. These are substantially identical and are explained in detail in the aforesaid patent application and in my U.S. Pat. No. 4,094,125. Consequently, they will be discussed only very briefly. They include curved members or rods with resilient sleeves around which streams of air are directed upwardly. These establish low pressure areas which move upper severed edges 52 (FIG. 3) outwardly and around the tops of the curved members. Clamping bars 54 then are moved downwardly by fluid-operated rams 56 to clamp the severed edges against the resilient sleeves. When the jaws 32 and 34 move apart, they open the upper edges 52 of a resulting severed package section indicated at 58 which has the lower transverse seal 42. An article to be packaged can then be dropped into the pocket formed in the severed section when in the position of FIG. 3.

Below the clamping means 50, the jaw 32, in this instance, has a second, lower backup strip 60 and the moveable jaw 34, in this instance, has a second, lower sealing strip or wire 62. When the jaws are together and the power is supplied to the sealing wire 62, a transverse seal is formed across the severed section 58 near the severed edges 52 to form what will be the lower end of the package, which is now completed except for the labeling thereof.

While the operation of the packaging station 12 will be essentially apparent from the above, it will now be described briefly. Starting with the jaws 32 and 34 open with the leading edge of the tubing 16 having the transverse seal 42 formed during a previous cycle, the tubing 16 is then advanced a predetermined distance to the position of FIG. 3 with the leading edge of the tubing well below the station 12. The advance of the tubing can be controlled, along with the operation of other components of the machine, by microprocessors, although more conventional components, such as counters, relays, limit switches, etc. can be employed, as is known in the art. When the tubing has stopped in the position of FIG. 2, the jaws 32 and 34 close, at which time power is supplied to the upper sealing wire 40 to seal what will be the leading edge of the tubing 16 thereabove. Air is supplied around the rods of the clamping means 50 and the knife 44 is moved across the tubing to form the upper severed edge 52 of what is now the lower package section 58. The clamping bars 54 are then moved down to clamp the severed edges, after which the jaws are opened. An article to be packaged is then dropped into the pocket formed by the nowopened section 58, by any suitable means. The jaws then close a second time and power is supplied to the lower sealing wire 62 to transversely seal the upper edge of the section 58, below the severed edges. This completes the package except for the label. After the label is applied, as will be discussed below, the jaws open again after the clamping means are released with the now-filled and formed package then dropping downwardly and being discharged below the stations 12 and 14. At this time, the knife blade 44 is also retracted to its original position.

While the above operations are proceeding, at the labeling station 14, a label 64 is being cut to length, shaped, transported, and subsequently affixed to the lower end of the package section 58, which will subsequently become the upper end of the package. The labeling station 14 includes two elongate frame members 66 and 68 and an end frame member 70 (FIGS. 1, 4 and 7). The spool 22 is rotatable on the axle 72 in notches 74 of the frame members 66 and 68 at the ends opposite the end frame member 70. In this instance, the strip 20 of labels has a central, longitudinally-extending perforate line 76 which facilitates bending the labels subsequently into a V-shaped configuration. The labels strip 20, also can have uniformly spaced apart pairs of openings 78 by means of which finished, labeled packages can be hung from suitable display hooks on hangers on a display board or stand, by way of example.

The strip 20 of labels is moved from the spool 22 over a guide roller 80 and then between adjustable guides 82 (FIG. 5) which engage edges of the strips 20. The guides 82 are mounted on threaded blocks 84 which are moved in and out by a threaded rod 86 extending through the frame members 66 and 68 and turned by knobs 88. The rod 86 is oppositely threaded to move the guides 82 in and out equal distances. Beyond the guides 82, the label strip 20 is fed between a lower drive roller 90 (FIG. 6) and upper drive rolls 92, which are driven through shafts 94 and 96 having gears 98 and 100 which rotate the roller 90 and the rolls 92 at the same peripheral speed.

The upper gear 100 is driven through the shaft 96 by a drive sprocket 102 (FIG. 4) which is connected to and disconnected from the shaft 96 by a commercially-available electric clutch and brake component 104. The sprocket 102 is connected through a chain 106 to a drive sprocket 108 of a gear reducer 110 and a motor 112. The motor 112 drives the sprockets 108 and 102 continuously while the electric clutch and brake component 104 is controlled through a suitable sensing device 114 which, in this instance, is shown as being mounted on one of the guides 82. The sensing device 114 controls the electric clutch and brake component 104 by means of the openings 78 in the label strip 20 but can also sense suitable marks on the label strip especially if the openings 78 are not employed therein. When the clutch portion of the clutch-brake component 104 is energized, the roller 90 and the rolls 92 are driven to advance the label strip 90 until the sensing device 114 senses another opening or mark, at which time it deenergizes the clutch portion of the component 104 and energizes the brake portion to immediately stop the label strip for accurate length control.

Referring to FIGS. 7–9, when the strip 20 is stopped, a shear indicated at 114 is operated to sever the label 64 from a leading edge portion of the label strip. The shear 114 includes a frame 116 mounted between the elongate frame member 66 and 68. A lower shear plate 118 is mounted on the frame 116 and has a sharp forward edge for shearing purposes. The shear also includes a mounting block 120 having a shear blade 122 depending therefrom which cooperates with the plate 118 to shear the label. The mounting block 120 is slidably mounted for vertical movement on guide rods 124 and is vertically moved by two fluid-operated rams 126.

A female V-shaped receiver block 128 has one position immediately in front of the shear 114 and receives the severed label 64 when in that position. The block 128 includes a V-shaped recess 130 with a chamber 132 formed below and communicating with the recess through a plurality of ports or openings 134. The chamber 132 communicates with a suitable vacuum source through flexible vacuum lines 136 to establish a suction at the recess 130 to aid in holding the label thereon. The V-shaped block 128 is mounted on a supporting block 138 which, in turn, is slidably supported by rails 140 mounted on the frame member 66. The block 138 is connected to a piston rod 142 of a fluid-operated ram 144 which moves the female V-shaped block 128 along the rails 140 between the receiving, retracted position, shown on dotted lines in FIG. 7, and a forward position, shown in solid lines in FIG. 7.

A male V-shaped block 146 with a V-shaped projection is positioned in alignment with and above the female block 128, when the latter is in the retracted position. The V-block 146 also has two positions, a retracted position, as shown in solid lines in FIGS. 7 and 9, and an extended position, shown in dotted lines in FIG. 9. In that position, the block 146 extends into the recess 130 of the block 128 to form the label into the V-shaped configuration where it is then held by suction. The block 146 is supported on a pair of piston rods 148 of fluid-operated rams 150 which are mounted on an extension 152 of the shear frame 116. When the label is formed into the V-shaped configuration by the cooperation of the blocks 128 and 146, the upper edges of the label extend well above the V-shaped recess 130, as noted in dotted lines in FIG. 9.

Figure 2:
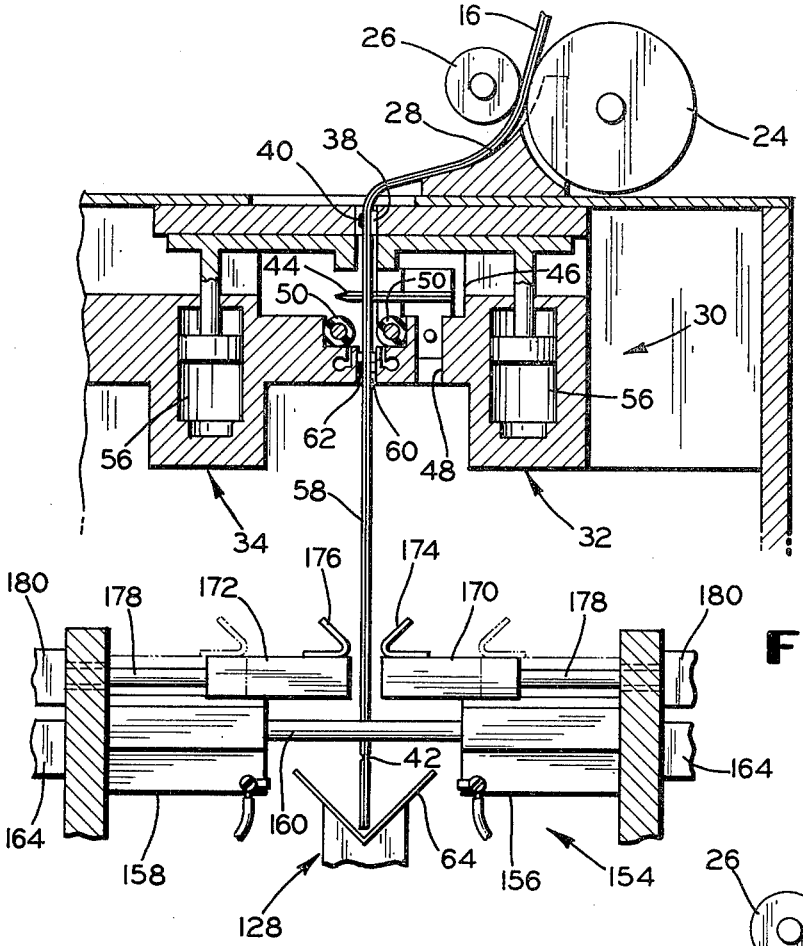
FIGS. 2 and 3 are schematic views in transverse cross section showing some sequential steps in the operation of the packaging machine.
Figure 3:
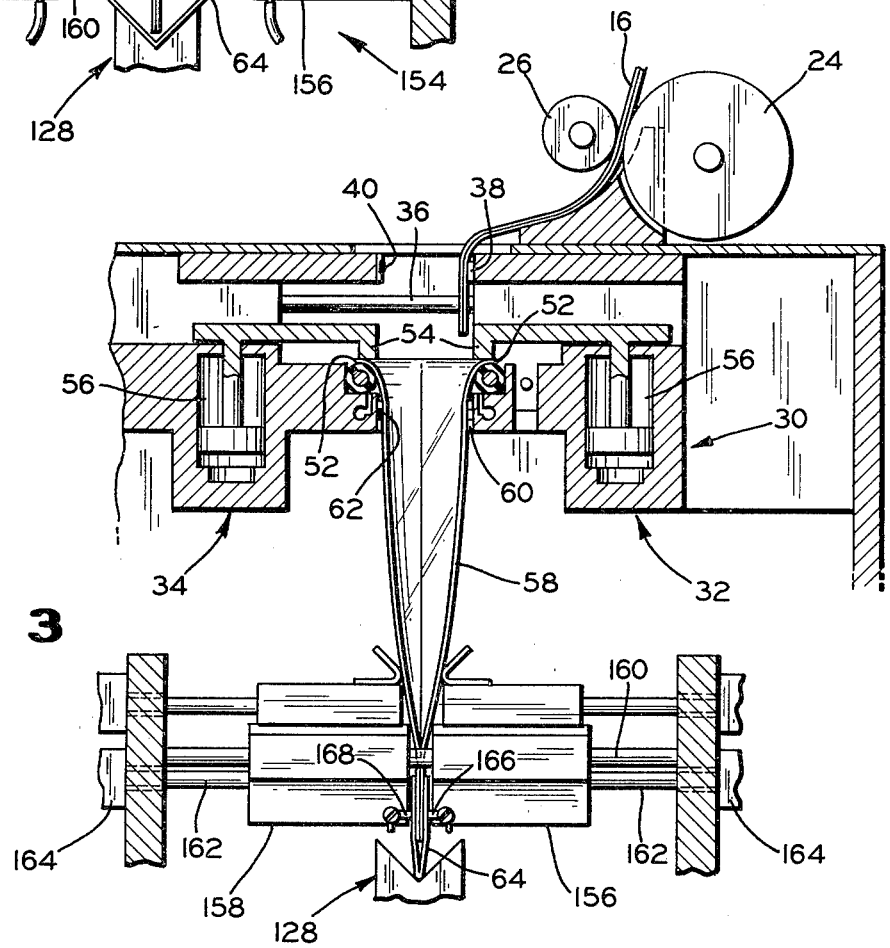

When the male V-shaped block 146 is raised, the female V-shaped block 128 is moved by the fluid-operated ram 144 to the forward position where it is centrally aligned in a transverse position relative to the path of the tubing 16 below the station 12. The valley of the V-shaped recess 130 is also in alignment with the path of the tubing 16, as shown in FIGS. 2 and 3. In this forward position, the block 128 can engage a limit switch, by way of example, which then operates a second set 154 of jaws 156 and 158. In this instance, both of the jaws 156 and 158 move in and out relative to the path of the tubing 16, being located on guide bars 160 and connected to piston rods 162 of pairs of fluid-operated rams 164. The jaws 156 and 158 have sealing strips or wires 166 and 168 thereon which engage the legs of the V-shaped label 64 when moving from the retracted position of FIG. 2 to the extended position of FIG. 3. These move the legs of the label against the leading edge of the package section 58, the sealing wires sealing them on transverse strips between the leading edge and the transverse seal 42 thereof. The adherance of the label to the plastic tubing at that position can be achieved through the heat-softenable nature of the plastic or the labels could also have heat-activated adhesive thereon. The jaws 156 and 158 subsequently open after a time delay at which time the female block 128 also retracts. After these operations, the clamping means 52 of the jaws 32 and 34 are released and those jaws open to discharge the completed, labeled package.

In many instances, it is desirable to hold the leading edge portion of the package section 58 in a central, still position as the V-shaped block 128 moves the V-shaped label 64 under the leading edge of the package section. Accordingly, two guide blocks 170 and 172 with slanted guide fins 174 and 176 can be slidably supported on top of the jaws 156 and 158. These blocks are moved between inner, guiding positions and outer positions by piston rods 178 connected to fluid-operated rams 180. The guides maintain the leading edge portion of the package section 58 centered and prevent it from moving transversely due to vibrations, breezes, etc. before the label is moved fully into position. The guide blocks are also moved to the guiding positions prior to the article to be packaged being dropped into the opened section 58 of FIG. 3; this provides support for the lower portion of the package section, particularly when heavier articles are being packaged. The guide blocks are moved to retracted positions prior to the completed and labeled package being released by the releasing means 50 of the jaws 32 and 34. Thus, the guide blocks 170 and 172 can move out at the same time as the heat jaws 156 and 158, although the blocks move to the inner positions prior to the inward movement of the jaws.

When packages of longer or shorter length are to be made, the labeling station 14 can accordingly be lowered or raised to maintain the V-shaped labels in proper position relative to the leading edges of the package section 58. For this purpose, raising and lowering mechanism indicated at 182 in FIG. 1 can be employed. This mechanism includes four vertical threaded rods 184 which are received through threaded ears 186 affixed to outer surfaces of the frame members 66 and 68. The lower ends of the rods 184 have sprockets 187 which are connected through chains 188. The rods are rotated simultaneously thereby with one of the sprockets 187 being turned through a chain 190 and a drive sprocket 192. The latter is connected to a gear reducer 194 and driven by a reversible motor 196. Hence, the entire station 14 is raised and lowered to accommodate packages of different lengths.

Various modifications of the above-described embodiment of the invention will be apparent to those skilled in the art and it is to be understood that such modifications can be made without departing from the scope of the invention if they are within the spirit and the tenor of the accompanying claims.

I claim:

1. A machine for making labeled packages from a length of flexible tubing and a strip of labels, said machine comprising means for advancing the tubing lengthwise along a path and for stopping the advance, first sealing means along the path forming a first transverse sealed strip across the tubing, means along the path beyond said first sealing means for severing the tubing near the sealed strip and forming a severed section, means along the path beyond said first sealing means and beyond said severing means for holding the severed edges of the severed section to open and close the severed section, second sealing means along the path beyond said holding means for forming a second transverse sealed strip near the severed edges, means for feeding the strip of labels along a path, means for severing a label from the strip, a first block having a generally V-shaped recess, a second block having a generally V-shaped projection, means for moving said second block transversely of the label path into and out of said recess of said first block, moving means for moving said first block with said V-shaped recess between a position adjacent said severing means and a position in which the label carried thereby is over the edge of the severed section, and third sealing means along the tubing path beyond said second sealing means for affixing the label to the severed section near the first transverse sealed strip.

2. A machine according to claim 1 characterized by said first block forming a chamber therein and having ports connecting said V-shaped recess and said chamber, and means for connecting said chamber with a vacuum source to hold the label in said recess with edge portions of the label extending beyond the recess.

3. A machine for making labeled packages from a length of flexible, plastic tubing, said machine comprising a first set of jaws between which the flexible tubing is fed downwardly, said jaws having first heat sealing means for forming a first transverse sealed strip across the tubing, said jaws having means below the first sealing means for severing the tubing below the sealed strip and forming a severed tubing section therebelow, said jaws having means below said severing means for clamping the severed edges of the severed section, said jaws being effective to open and close the severed section when said jaws are moved relatively toward and away from one another, said jaws having second heat sealing means below said clamping means for forming a second transverse sealed strip across the severed section below the severed edges thereof, means for moving a label in a generally V-shaped configuration over the lower edge of the severed section near the first transverse sealed strip, and a second set of jaws below said first set of jaws having third sealing means below said second sealing means for engaging the label and affixing the label to the severed section near the first transverse sealed strip.

4. A machine according to claim 3 characterized by the labels being supplied in the form of a strip, said machine further including means for feeding a strip of labels along a path, means for severing a label from the strip, and means for forming the label into a generally V-shaped configuration prior to the moving means moving the label over the lower edge of the severed section.

5. A machine according to claim 4 characterized by said means for forming the label into a generally V-shaped configuration comprising a block with a V-shaped recess, and said means for moving the label over the edge of the severed section comprising fluid-operated means for moving said block with a label held thereon.

6. A machine according to claim 5 characterized by means for applying suction to the V-shaped recess of said block to aid in holding the label.

7. A machine according to claim 3 characterized by said third sealing means comprising a heatable wire carried by each of said jaws of said second set.

8. A machine according to claim 3 characterized by means for moving said moving means and said second set of jaws in directions toward and away from said first set of jaws to accommodate packages of different lengths.

9. A machine for labeling packages, the packages having transverse seals near leading edges thereof, said machine comprising means for moving a continuous strip of labels along a path, means for severing labels from the strip of labels, means for forming the labels into generally V-shaped configurations and for moving the shaped labels over the leading edges having the transverse sealed strips, means for affixing the labels to the packages near the transverse seals, and means movable toward and away from the packages independently of movement of said affixing means for centering the leading edges of the packages with respect to the shaped labels.

10. A machine according to claim 9 characterized by said forming means comprising a block having a V-shaped recess, a second block having a V-shaped projection, means for moving the V-shaped projection of said second block into and out of the V-shaped recess of said first block, and means for moving said first block carrying the V-shaped label in the recess in a path between a position adjacent said severing means and a position adjacent the leading edges of the packages.

11. A machine for labeling packages, the packages having transversely sealed leading edges, said machine comprising a first block having a generally V-shaped recess and a second block having a generally V-shaped projection, means for moving said second block toward and away from said first block to move said projection into said recess to shape a label into a V-shaped configuration, and means for moving said first block with the labels carried by said V-shaped recess toward and away from the leading edges of the packages, means for engaging projecting portions of said labels above said V-shaped recess and affixing said label portions to the packages near the transversely sealed edges, jaw means for producing the packages sequentially from the length of flexible tubing, and means for moving said first block, said second block, said block moving means, and said affixing means together as a unit toward and away from said jaw means to change the length of the labels applied to the packages.

12. A machine according to claim 11 characterized by said labels being supplied from a continuous strip thereof, and said machine further comprising means for moving the continuous strip of labels along a path, and means for severing labels from the strip prior to forming the labels into the V-shaped configurations by said first and said second blocks.

13. A machine for making labeled packages from a length of flexible tubing and a strip of labels, said machine comprising means for advancing the tubing lengthwise along a path and for stopping the advance, first sealing means along the path forming a first transverse sealed strip across the tubing, means along the path beyond said first sealing means for severing the tubing near the sealed strip and forming a severed section, means along the path beyond said first sealing means and beyond said severing means for holding the severed edges of the severed section to open and close the severed section, second sealing means along the path beyond said holding means for forming a second transverse sealed strip near the severed edges, means for feeding the strip of labels along a path, means for severing a label from the strip, means for forming the label into a predetermined shape, means for moving the label over the edge of the severed section near the first transverse sealed strip, third sealing means along the tubing path beyond said second sealing means for affixing the label to the severed section near the first transverse sealed strip, a pair of guide blocks located above said third sealing means, and means for moving said guide blocks between a position adjacent the lower portion of the severed section and a position retracted from the severed section, independently of movement of said third sealing means.

14. A machine for labeling packages, the packages having transverse seals near leading edges thereof, said machine comprising means for moving a continuous strip of labels along a path, means for severing labels from the strip of labels, means for forming the labels into generally V-shaped configurations and for moving the shaped labels over the leading edges having the transverse sealed strips, means for affixing the labels to the packages near the transverse seals, jaw means for producing the packages sequentially from a length of flexible tubing, and means for moving said strip moving means, said severing means, said forming means, and said affixing means toward and away from said jaw means as a unit to change the length of the labels applied to the packages.

* * * * *